United States Patent [19]

Grohoski et al.

[11] Patent Number: 4,827,817

[45] Date of Patent: May 9, 1989

[54] SANITARY NAPKIN DISPENSER

[76] Inventors: Jane Grohoski, P.O. Box 325; Diane Marinari, 458 Kleman Rd., both of Gilbertsville, Pa. 19525

[21] Appl. No.: 46,636

[22] Filed: May 7, 1987

[51] Int. Cl.[4] ..... B26D 5/10

[52] U.S. Cl. ..... 83/234; 83/241; 83/649; 83/694

[58] Field of Search ..... 83/649, 694, 696, 636, 83/249, 263, 267, 234, 240, 241, 202

[56] References Cited

U.S. PATENT DOCUMENTS

| | | | |
|---|---|---|---|
| 2,612,425 | 9/1952 | Jacobson | 83/649 X |
| 3,418,875 | 12/1968 | Friedman | 83/696 X |
| 4,651,610 | 3/1987 | Schwelling | 83/694 X |

*Primary Examiner*—Donald R. Schran

*Attorney, Agent, or Firm*—Fleit, Jacobson, Cohn & Price

[57] ABSTRACT

A sanitary napkin dispenser and more specifically a dispenser capable of supplying sanitary napkins at a site of use from a continuous web wound into a spiral roll with the length characteristics of the napkin being varied depending upon the requirements of a user. The sanitary napkin supplied may be multi-layered and provided with a moisture proof outer layer which may also be provided with arrangements for securing the napkin to a sanitary belt or to the interior surface of panties, pantyhose or similar garments thereby enabling a person to obtain a required sanitary napkin at a site of use rather than being required to transport a supply of sanitary napkins for use as may be required while traveling, working and the like.

5 Claims, 1 Drawing Sheet

SANITARY NAPKIN DISPENSER

BACKGROUND OF THE INVENTION

Field of the Invention

The present invention generally relates to a sanitary napkin dispenser and more specifically a dispenser capable of supplying sanitary napkins at a site of use from a continuous web wound into a spiral roll with the length characteristics of the napkin being varied depending upon the requirements of a user. The sanitary napkin supplied may be multi-layered and provided with a moisture proof outer layer which may also be provided with arrangements for securing the napkin to a sanitary belt or to the interior surface of panties, pantyhose or similar garments thereby enabling a person to obtain a required sanitary napkin at a site of use rather than being required to transport a supply of sanitary napkins for use as may be required while traveling, work and the like.

INFORMATION DISCLOSURE STATEMENT

Sanitary napkins have been provided in dispensers but such devices usually involve separately wrapped or packaged sanitary napkins of a predetermined size which may or may not satisfy the requirements of an individual user. Applicants are not aware of any prior art that discloses a structure similar to the present invention. A separate information disclosure statement will be filed.

SUMMARY OF THE INVENTION

An object of the present invention is to provide a sanitary napkin dispenser capable of discharging individual sanitary napkins from a continuous web wound spirally into a supply roll positioned within a housing so that an individual user may obtain a sanitary napkin of desired physical characteristics commensurate with the requirements of the user thereby eliminating the necessity of the user carrying a supply of sanitary napkins during travel, while at work or at other times when not a location that has a supply of packaged or purchased sanitary napkins available.

Another object of the invention is to provide a sanitary napkin dispenser including a continuous web roll of sanitary napkins of uniform, multi-layered construction throughout the length thereof so that the length of the sanitary napkin being dispensed may be varied depending upon the requirements of each individual user.

A further object of the invention is to provide a sanitary napkin dispenser in accordance with the preceding objects in which the sanitary napkin being dispensed include provisions for closing and sealing the ends thereof as well as arrangements for securing the sanitary napkin to the interior of panties, pantyhose and the like and to a sanitary napkin supporting belt if available.

Still another important object of the present invention is to provide a sanitary napkin dispenser which is relatively simple in construction and easy to operate and capable of being installed at various points of use so that sanitary napkins are readily available at home, at work sites, establishments which cater to travelers and other sites removed from locations which normally have a supply of sanitary napkins available.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
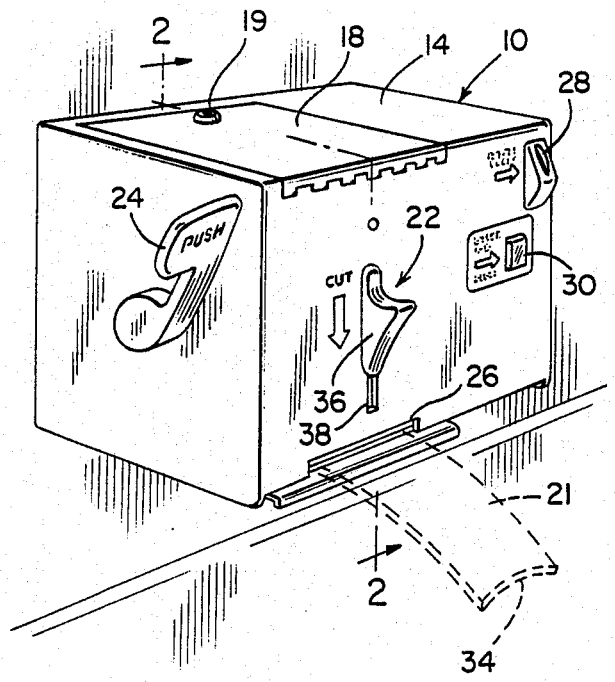
FIG. 1 is a perspective view of the sanitary napkin dispenser of the present invention.
Figure 2:
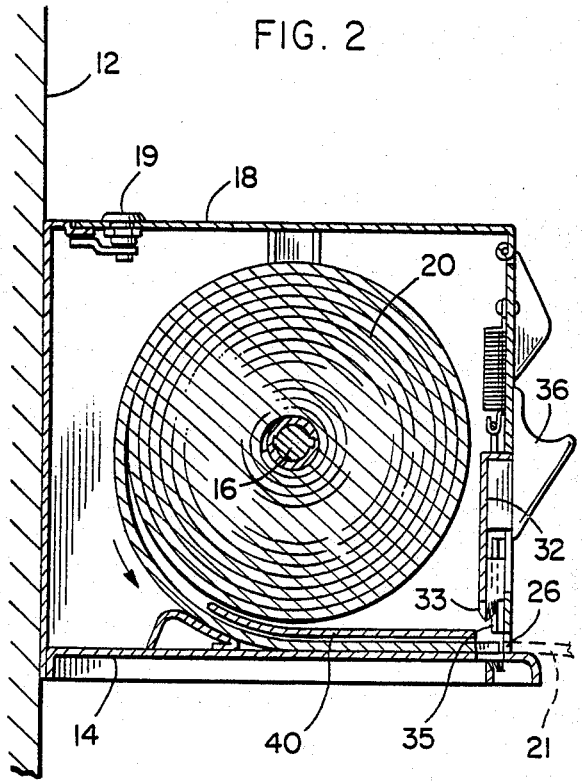
FIG. 2 is a vertical sectional view taken generally upon section line 2—2 on FIG. 1 illustrating further structural details of the invention.
Figure 3:
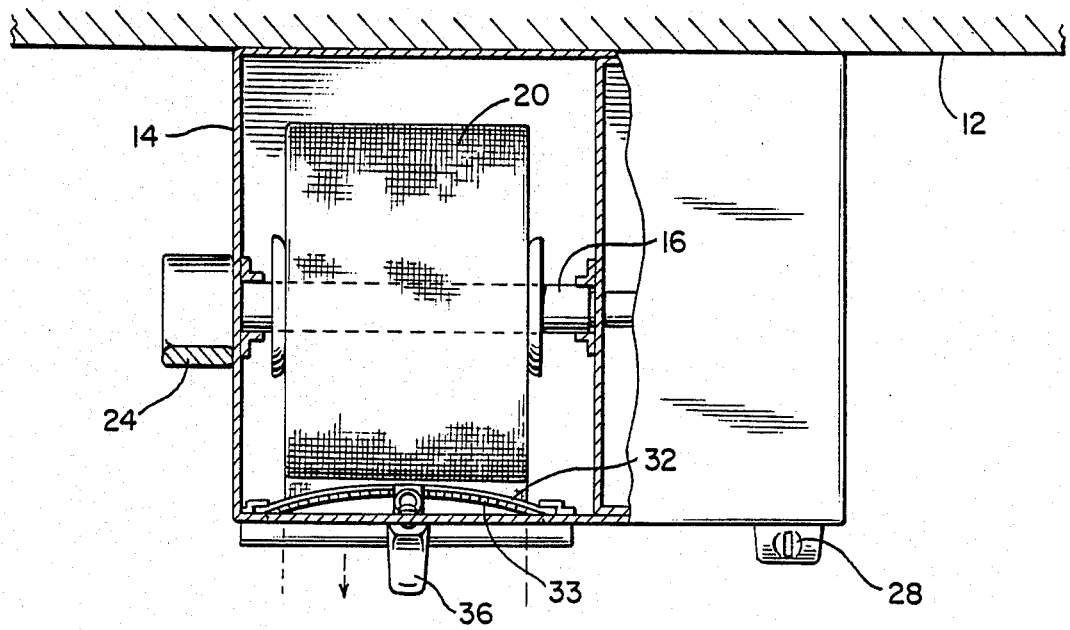
FIG. 3 is a more detailed view illustrating the structure for severing a sanitary napkin from the continuous web roll.

Referring now specifically to the drawings, the sanitary napkin dispenser of the present invention is generally designated by the reference numeral 10 and, as illustrated, many be mounted on a wall surface 12 in a bathroom or restroom such as in homes, restaurants, service stations, various work places and in other locations where packaged sanitary napkins or sanitary napkins of a desired length are not readily available but may be required by persons traveling, working or otherwise located at a site remote from the location of a supply of packaged sanitary napkins thereby eliminating the necessity of a user of sanitary napkins transporting a supply of sanitary napkins while traveling, eating out, working or engaged in other activities that require being located at a point remote from a supply of conventional sanitary napkins.

The dispenser includes a hollow housing 14 with a spindle 16 supported therein in a generally horizontal manner with the housing including an access door 18 with key lock 19 to enable access into the interior of the housing in order to renew or replenish the spiral wound roll 20 of a continuous web from which individual sanitary napkins 21 may be removed by a cutting or severing mechanism generally designated by reference numeral 22. For home use, the spindle 16 may be rotated by a handle 24 connected to the spindle 16 through a ratchet mechanism (not shown in detail) to enable a desired length of sanitary napkin 21 to be extended through a discharge slot 26 in the front wall of housing 14 so that the cutter mechanism 22 can be actuated manually to sever the napkin 21 from the supply roll 20.

Alternatively, in other installations, the dispenser may be provided with a motor drivingly connected with the spindle 16 in a manner to discharge the continuous web through the discharge slot 26 with a coin control apparatus being utilized so that upon deposit of an appropriate coin or coins into coin slot 28 and depression of a control button 30, the motor would be actuated for whatever time period necessary to discharge a desired length of sanitary napkin although the time of operation would be limited to limit the maximum length of sanitary napkin to be dispensed through the discharge slot 26. Alternatively, a coin control device may be provided to release the spindle and roll so that a desired length of sanitary napkin up to a maximum could be discharged by operating handle 24 or manually pulled through the discharge slot after which the cutting mechanism could be actuated to sever the desired length of sanitary napkin.

Preferably the sanitary napkin 21 will be of multilayered construction with the outermost layer being moisture proof and the innermost layer or layers being absorbent and layer or layers of absorbent material may be provided between the innermost and the outermost layers, all of which may be secured together with spots of adhesive. The exterior surface of the outer layer of the sanitary napkin may be provided with adhesive spots having a protective cover therefor which can be removed with the adhesive spots being pressure sensitive adhesive or the like so that the sanitary napkin may be secured to the interior surface of panties, pantyhose or similar garments. Also, removable adhesive strips or spots may be provided on the exterior surface which enable the severed end edges of the sanitary napkin to be folded inwardly into a closed relation with the adhesive strips or spots retaining the ends of the sanitary napkin in folded and closed and sealed relation which specifically retains the abosrbent material therein and facilitates connection with a sanitary belt if available and retains the absorbent layered material within the napkin.

The housing and spindle structure may be constructed so that two webs of sanitary napkins may be mounted thereon with the two webs being of different widths and also of different absorbency characteristics to further provide a selection of physical characteristics of the sanitary napkin to be dispensed. In the event of two webs being used, separate control arrangements may be provided for the wider and more absorbent sanitary napkins and the narrower and less absorbent sanitary napkins. The cutter mechanism 22 is of the guillotine type and includes a vertically sliding blade 32 of concave cross-sectional configuration in order to form contoured ends 34 on the napkin 21 for better conformation with the body surfaces and to render the napkin more comfortable in use. The blade 32 has a convex serrated cutting edge 33 which may be arcuately curved for mating with a correspondingly serrated and curved stationary cutting edge on an anvil blade 35 mounted below the slot 26 to more easily and effectively cut the multi-layered napkin in a manner similar to cutting with pinking shears. A handle 36 extends through a vertical slot 38 to move the blade 32 vertically and a guide chute 40 is provided to guide the sanitary napkin through the slot 26. With the present invention installed at various locations where sanitary napkins are needed, individuals who require the use of sanitary napkins are less restricted in their travel modes since they no longer have to carry a supply of sanitary napkins with them in a pocketbook, handbag or the like.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A sanitary napkin dispenser comprising a housing, a supply roll of multi-layered sanitary napkin material in the form of a continuous web mounted in said housing, said housing including a discharge slot through which the end of the web of sanitary napkin material extends and cutting means on said housing for severing a desired length of sanitary napkin from the supply roll thereby enabling a sanitary napkin having desired length characteristics to be obtained when required without the necessity of transporting separately packaged sanitary napkins to a point of use, said supply roll of sanitary napkin material being mounted on a spindle for rotation in the housing, means rotating the spindle and supply roll independently of the cutting means for discharging a predetermined selective length of sanitary napkin material through the discharge slot, said cutting means including a vertically disposed guillotine blade, means slidably supporting the blade in the housing, said housing being provided with an external handle for moving the blade vertically toward the slot for engagement with the upper surface of the sanitary napkin material and an anvil blade mounted on the housing below the slot generally in opposed relation to the vertically movable blade so that as the movable blade moves downwardly past the anvil blade, the sanitary napkin material will be severed.

2. The structure as defined in claim 1 wherein said movable blade and anvil blade are convex in cross-sectional configuration to form a convex rounded end on one end of the sanitary napkin and a concave rounded end on the other end of the sanitary napkin severed from the supply roll of sanitary napkin material.

3. The structure as defined in claim 2 wherein the cutting edges of the movable blade and anvil blade are serrated with the movable blade having a convex serrated edge to provide progressive cutting from the center of the sanitary napkin material towards the outer edges thereof and to provide notched end edges on the sanitary napkin.

4. The structure as defined in claim 3 wherein said sanitary napkin material includes a moisture proof outer layer, an inner layer and intermediate absorbent layers secured together by spots of adhesive, the outer layer having adhesive areas adjacent the ends thereof to enable the ends to be folded over into closed relation with the adhesive securing the ends in folded over closed relation.

5. The structure as defined in claim 4 wherein the outer layer of the sanitary napkin material is provided with adhesive spots spaced from the adhesive areas for securing the sanitary napkin to the inner surface of undergarments such as panties, pantyhose and the like for securing the sanitary napkin in desired position.

* * * * *